US007431816B2

(12) United States Patent
Maeyama et al.

(10) Patent No.: US 7,431,816 B2
(45) Date of Patent: Oct. 7, 2008

(54) METHOD OF MANUFACTURING HEAT RESISTANT RESIN FILM WITH METAL THIN FILM

(75) Inventors: Ryuichiro Maeyama, Ashigarakami-gun (JP); Kazuyoshi Itoh, Ashigarakami-gun (JP); Yasutaka Naito, Ashigarakami-gun (JP); Hideaki Ohara, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 677 days.

(21) Appl. No.: 10/856,849

(22) Filed: Jun. 1, 2004

(65) Prior Publication Data

US 2004/0219376 A1 Nov. 4, 2004

Related U.S. Application Data

(62) Division of application No. 09/977,298, filed on Oct. 16, 2001, now abandoned.

(30) Foreign Application Priority Data

Dec. 20, 2000 (JP) ..... 2000-387345
Jul. 11, 2001 (JP) ..... 2001-210647

(51) Int. Cl.
*C25D 5/56* (2006.01)

(52) U.S. Cl. ..... 205/158; 205/151; 205/208; 205/210; 205/224; 264/311

(58) Field of Classification Search ..... 205/158
See application file for complete search history.

(56) References Cited

U.S. PATENT DOCUMENTS 3,865,699 A * 2/1975 Luch ..... 205/158
3,923,392 A 12/1975 Buchan et al.
4,407,580 A 10/1983 Hashimoto et al.
4,590,115 A * 5/1986 Cassat ..... 428/174
5,057,370 A 10/1991 Krieg et al.
5,158,846 A 10/1992 Bujese
5,172,173 A 12/1992 Goto et al.
5,246,910 A 9/1993 Koshizuka et al.

(Continued)

FOREIGN PATENT DOCUMENTS

EP 0193978 7/1986

(Continued)

OTHER PUBLICATIONS

Arthur Rose, The Condensed Chemical Dictionary, seventh edition, Reinhold Book Corporation, New York, 1966, pp. 564.*

(Continued)

*Primary Examiner*—Susy Tsang-Foster
*Assistant Examiner*—William T Leader
(74) *Attorney, Agent, or Firm*—Oliff & Berridge, PLC

(57) ABSTRACT

A method for manufacturing a heat resistant resin film with a metal thin film is configured to include the steps of: biasing a conductive material to one surface of the heat resistant resin film; and applying electrolytic plating to the heat resistant resin film while using the conductive material biased to the one surface of the heat resistant resin film as an electrode, so as to form a metal thin film on the heat resistant resin film.

17 Claims, 10 Drawing Sheets

U.S. PATENT DOCUMENTS

| | | | |
|---|---|---|---|
| 5,534,581 | A | 7/1996 | Ohtani et al. |
| 6,066,400 | A | 5/2000 | Law et al. |
| 6,139,784 | A | 10/2000 | Oshima et al. |
| 6,336,025 | B1 | 1/2002 | Saeki |
| 6,368,718 | B1 | 4/2002 | Schmidt |
| 6,376,594 | B1 | 4/2002 | Sasagawa et al. |
| 6,476,113 | B1 | 11/2002 | Hiles |

FOREIGN PATENT DOCUMENTS

| | | | |
|---|---|---|---|
| JP | 359093342 | | 11/1982 |
| JP | 01-043038 | | 9/1989 |
| JP | 5-299820 | A | 11/1993 |
| JP | 05-327207 | | 12/1993 |
| JP | 6-256960 | A | 9/1994 |
| JP | 6-316768 | A | 11/1994 |
| JP | 7-216225 | A | 8/1995 |
| JP | 11-073036 | | 3/1999 |
| JP | 11-352804 | | 12/1999 |
| JP | 2000-141542 | | 5/2000 |

OTHER PUBLICATIONS

F. A. Lowenheim, Electroplating, McGraw-Hill Book Co., New York, 1978, pp. 416-417.*

* cited by examiner

METHOD OF MANUFACTURING HEAT RESISTANT RESIN FILM WITH METAL THIN FILM

CROSS-REFERENCE TO RELATED APPLICATION

This application is a divisional application of application Ser. No. 09/977,298, filed Oct. 16, 2001, now abandoned, incorporated herein by reference in its entirety.

BACKGROUND OF THE INVENTION

1. Field of Invention

The present invention relates to a heat resistant resin film with a metal thin film used as an intermediate transferor like an endless belt, a fixing belt of a fixing unit, or the like in an image forming apparatus for forming an image with dry toner by use of an electrophotographic system, an electrostatic recording system or the like, the image forming apparatus such as a printer, a copying machine, or the like; a method for manufacturing such a heat resistant resin film; such an endless belt; a method for manufacturing such an endless belt; and such an image forming apparatus.

2. Description of Related Art

A thin film of conductive metal such as copper, aluminum, or the like, is laminated on a thin plate made of heat resistant resin, or a thin plate in which a core material made of glass fiber or the like has been impregnated with heat resistant resin. Such a laminate is hitherto used broadly as a printed wiring board. Also in an image forming apparatus such as a printer, a copying machine, or the like, for forming an image with dry toner by use of an electrophotographic system, an electrostatic recording system or the like as described above, a film in which a heat resistant resin film and a metal thin film have been laminated on each other and which has been formed into an endless shape is sometimes used as an intermediate transferor or the like, which is transferred a dry toner image formed on an image carrier such as a photoconductor drum and holds the toner image temporarily.

An electrostatic latent image is formed on the photoconductor drum and toner is made to adhere to the electrostatic latent image. Thus, the electrostatic latent image is developed by toner and then transferred onto the endless intermediate transferor. Then, in the endless intermediate transferor having the toner image transferred thereon, the metal thin film laminated onto the heat resistant resin is made to generate heat by use of an electromagnetic induction effect. Thus, the toner image transferred onto the intermediate transferor is heated so that the toner image is transferred and fixed simultaneously on a recording medium which is pressed onto the intermediate transferor at predetermined timing.

A schematic configuration of such an image forming apparatus will be described next.

FIG. 12A is a schematic configuration view showing the above-mentioned image forming apparatus. This image forming apparatus is a full-color laser printer using an electrophotographic system. FIG. 12B is an enlarged view showing a main portion of the same image forming apparatus. This image forming apparatus has a photoconductor drum 101 on a surface of which a latent image based on a difference in electrostatic potential is formed. Around the photoconductor drum 101, the image forming apparatus has a charging unit 102 for charging the surface of the photoconductor drum 101 substantially uniformly; an exposure section for irradiating the photoconductor drum 101 with laser light in accordance with signals of respective colors of cyan, magenta, yellow, black, and so on, so as to form an electrostatic latent image on the photoconductor drum 101, the exposure section provided with a laser scanner 103, a mirror 104 and so on; a rotary developing unit 105 for storing toners of four colors of cyan, magenta, yellow and black respectively, and visualizing the electrostatic latent image on the photoconductor drum 101 with the respective color toners; an intermediate transferor 106 supported movably circularly in a fixed direction and shaped like an endless belt; a cleaning unit 107 for cleaning the surface of the photoconductor drum 101 after the transfer; and an exposure lamp 108 for removing charge from the surface of the photoconductor drum 101.

The endless intermediate transferor 106 is stretched around a driving roller 110 and a tension applying member 111. A pressure roller 112 is provided to press the driving roller 110 through the intermediate transferor 106. An electromagnetic induction heating unit 113 for heating the intermediate transferor 106 is provided on an upstream side of a position where the driving roller 110 and the pressure roller 112 are opposed to each other, in the moving direction of the intermediate transferor 106.

Further, a paper feed roller 116 and a registration roller 117 both for carrying, one by one, a recording material which is stored in a paper feed unit 115 and a recording material guide 118 for feeding the recording material between the intermediate transferor 106 and the pressure roller 112 are provided in the image forming apparatus.

The electromagnetic induction heating unit 113 has an exciting coil 113*a* to generate an alternating magnetic field passing through the intermediate transferor 106, as shown in FIG. 13. On the other hand, the intermediate transferor 106 has a base layer 106*a*, a conductive layer 106*b* (electromagnetic induction heating layer) laminated on the base layer 106*a*, and a releasable layer 106*c* superior in releasability. An eddy current B is generated in the conductive layer 106*b* by the alternating magnetic field. The conductive layer 106*b* generates heat due to the eddy current B so as to heat and melt the toner image carried on the surface of the intermediate transferor 106.

In such an image forming apparatus, the respective color toner images formed on the photoconductor drum 101 are transferred sequentially onto the intermediate transferor 106 by a bias voltage applied between the photoconductor drum 101 and the driving roller 110, so as to be superimposed on one another. Thus, a full-color toner image is formed. The conductive layer 106*b* of the intermediate transferor 106 is heated by electromagnetic induction so that the toner image is melted. The melted toner image is superimposed on a recording material, and subjected to compression bonding to the recording material between the pressure roller 112 and the driving roller 110. Thus, the toner image is transferred to the recording material and fixed thereon simultaneously.

For example, a film-like member having a thickness of 50 to 200 μm and made of heat resistant resin such as thermosetting polyimide, aromatic polyamide (aramid), liquid crystal polymer, or the like and a copper thin film having a thickness of about 1 to 50 μm are laminated on each other to form an endless belt, and the endless belt is used as the intermediate transferor 106.

As methods for manufacturing a film-like member in which a heat resistant resin layer and a metal thin film have been laminated on each other as mentioned above, there have been known a method in which a heat resistant resin film and a sheet of metal foil are bonded with each other by an adhesive agent or the like; a method in which a metal thin film is formed on a heat resistant resin film by means of electrolytic plating, electroless plating, vapor deposition, or the like; and so on.

However, in the method in which a heat resistant resin film and a sheet of metal foil are bonded with each other by an adhesive agent or the like as mentioned above, there is a problem that not only is the process of work complicated, but reliability is also lacked in the bonding force between the heat resistant resin film and the sheet of metal foil when the metal thin film is heated repeatedly by electromagnetic induction.

On the other hand, also in the method in which a metal thin film is formed on a heat resistant resin film by means of electrolytic plating, electroless plating, vapor deposition, or the like, there is a problem that heat resistant resin such as polyimide or aromatic polyamide (aramid) is generally high in surface energy so that the bonding property deteriorates and hence it is difficult to make the heat resistant resin firmly adhere to the metal thin film of copper or the like.

Therefore, for example, JP-A-Hei. 5-299820, JP-A-Hei. 6-316768, JP-A-Hei. 7-216225, JP-A-Hei. 6-256960, and so on, disclose techniques for solving such problems and improving the bonding property between the heat resistant resin and the metal thin film.

JP-A-Hei. 5-299820 proposes the following technique. That is, a metal deposited film is formed on polyimide. Then, a copper layer based on electron beam heating deposition and a copper layer based on electrolytic plating are laminated on the metal deposited film sequentially.

Moreover, JP-A-Hei. 6-316768 discloses the following technique. That is, polyimide is impregnated with fluororesin in advance. In order to make the fluororesin a bonding site, a first stage of etching treatment is first carried out with a water solution containing hydrazine, and succeedingly a second stage of etching treatment is carried out with naphthalene-1-sodium so as to make it easy for copper to adhere thereto.

Further, JP-A-Hei. 7-216225 discloses the following technique. That is, metal powder is mixed into a precursor of polyimide in advance. Thus, the bonding property with a metal film based on plating is enhanced.

Furthermore, JP-A-Hei. 6-256960 proposes the following technique. That is, even if the heat resistant resin is aromatic polyamide (aramid), etching treatment is carried out with a water solution containing hydrazine and alkali metal hydroxide. Succeedingly, catalyst applying treatment for electroless plating is carried out.

However, the above-mentioned techniques according to the related art have problems as follows. That is, in each of the techniques disclosed in JP-A-Hei. 5-299820, JP-A-Hei. 6-316768, JP-A-Hei. 7-216225, JP-A-Hei. 6-256960, and so on, chemical treatment or the like is applied to the surface of heat resistant resin to form a metal thin film after the heat resistant resin is molded. In these methods, however, there has been a problem that a sufficient bonding property cannot be obtained between the heat resistant resin and the metal thin film, or the process of the chemical treatment is complicated so that it is difficult to rationalize the manufacturing process.

SUMMARY OF THE INVENTION

Accordingly, the present invention is to solve the above described problems. An object of the present invention is to provide a heat resistant resin film with a metal thin film in which the metal thin film has sufficient mechanical strength and which can be manufactured in a simple process and at a low cost; a method for manufacturing the heat resistant resin film; an endless belt; a method for manufacturing the endless belt; and an image forming apparatus.

In order to solve the above problems, according to a first aspect of the present invention, there is provided A method for manufacturing a heat resistant resin film with a metal thin film, comprising the steps of: biasing a conductive material to one surface of the heat resistant resin film; and applying electrolytic plating to the heat resistant resin film by using the conductive material biased to the one surface of the heat resistant resin film as an electrode to form a metal thin film on the heat resistant resin film.

According to a second aspect of the invention, there is provided the method according to the first aspect of the invention, wherein the step of biasing uses a difference in specific gravity between the heat resistant resin and the conductive material.

According to a third aspect of the invention, there is provided the method according to the second aspect of the invention, wherein the use of the difference in specific gravity between the heat resistant resin and the conductive material is a centrifugal molding method in which at least one of an inorganic conductive material and an organic conductive material is subjected to gradient molding.

According to a fourth aspect of the invention, there is provided the method according to the second aspect of the invention, wherein the use of the difference in specific gravity between the heat resistant resin and the conductive material is dipping in which at least one of an inorganic conductive material and an organic conductive material is collected near the one surface.

According to a fifth aspect of the invention, there is provided the method according to any one of the first to fourth aspects of the invention, further comprising the steps of etching the one surface of the heat resistant resin so that the conductive material existing near the one surface acts as an electrode, wherein the etching is one of abrasion, sandblasting, and chemical etching.

According to a sixth aspect of the invention, there is provided the method according to any one of the first to fifth aspects of the invention, wherein the conductive material is metal particles.

According to a seventh aspect of the invention, there is provided the method according to any one of the first to fifth aspects of the invention, wherein the conductive material is organic conductive polymer.

According to a eighth aspect of the invention, there is provided the method according to any one of the first to seventh aspects of the invention, wherein the heat resistant resin is a heat resistant resin having polyimide as a main component.

According to a ninth aspect of the invention, there is provided a heat resistant resin film with a metal thin film, wherein the metal thin film is formed by applying electrolytic plating to the heat resistant resin film by using a conductive material biased to one surface of the heat resistant resin film as an electrode.

According to a tenth aspect of the invention, there is provided the heat resistant resin film according to the ninth aspect of the invention, wherein the conductive material biased to the one surface of the heat resistant resin film is biased by using a difference in specific gravity between the heat resistant resin and the conductive material.

According to an eleventh aspect of the invention, there is provided the heat resistant resin film according to the tenth aspect of the invention, wherein the conductive material biased to the one surface of the heat resistant resin film by using the difference in specific gravity between the heat resistant resin and the conductive material is biased by centrifugal molding.

According to a twelfth aspect of the invention, there is provided the heat resistant resin film according to the tenth aspect of the invention, wherein the conductive material biased to the one surface of the heat resistant resin film by using the difference in specific gravity between the heat resistant resin and the conductive material is biased by dipping.

According to a thirteenth aspect of the invention, there is provided the heat resistant resin film according to any one of the ninth to twelfth aspects of the invention, wherein the one surface of the heat resistant resin is etched so that the conductive material existing near the one surface acts as an electrode; and wherein the etching is one of abrasion, sandblasting, and chemical etching.

According to a fourteenth aspect of the invention, there is provided the heat resistant resin film according to any one of the ninth to thirteenth aspects of the invention, wherein the conductive material is metal particles.

According to a fifteenth aspect of the invention, there is provided the heat resistant resin film according to any one of the ninth to thirteenth aspects of the invention, wherein the conductive material is organic conductive polymer.

According to a sixteenth aspect of the invention, there is provided the heat resistant resin film according to any one of the ninth to fifteenth aspect of the invention, wherein the heat resistant resin is heat resistant resin having polyimide as a main component.

According to a seventeenth aspect of the invention, there is provided a method for manufacturing an endless belt comprising the steps of forming the heat resistant resin film according to any one of the first to eighth aspects of the invention into an endless shape.

According to an eighteenth aspect of the invention, there is provided the method according to the seventeenth aspect of the invention, wherein the metal thin film generates heat due to electromagnetic induction heating.

According to a nineteenth aspect of the invention, there is provided an endless belt, wherein the heat resistant resin film according to any one of the first to eighth aspects of the invention is formed into an endless shape.

According to a twentieth aspect of the invention, there is provided the endless belt according to the nineteenth aspect of the invention, wherein the metal thin film generates heat due to electromagnetic induction heating.

Examples of the above-mentioned heat resistant resin may include polyester, polyethylene terephthalate, polyethersulfone, polyetherketone, polysulfone, polyimide, polyimide amide, polyamide, and so on. Particularly, it is preferred to use a material classified as polyimide, aromatic polyamide, or thermotropic liquid crystal polymer. Examples of the thermotropic liquid crystal polymer may include perfect aromatic polyester, aromatic-aliphatic polyester, aromatic polyazomethine, aromatic polyester-carbonate, polybenzimidazole, and so on. Particularly, polybenzimidazole is preferred because its thermal expansion coefficient is small. These examples may be used in desired mixture.

As a method for forming a layer of such heat resistant resin, if it is thermoplastic one, extrusion molding or centrifugal molding can be applied to the melted resin. If the resin can be molded as a polymer solution or a polymer alloy solution, the resin can be molded into a film by application or flow casting. Thus, existing methods may be used in accordance with the materials.

An inorganic or organic conductive material having a function as an electrode is dispersed into such a molding material in advance. At a time of molding, the conductive material is collected (biased) on the interface with the heat resistant resin due to a difference in specific gravity or the like so that electrolytic plating can be carried out with the collected conductive material as an electrode.

In such a method, a metal thin film is formed in a state where metal firmly sticks to the conductive material formed previously and having a function as an electrode. Thus, a laminate body in which the metal thin film and the layer of the heat resistant resin have adhered to each other firmly and physically can be obtained easily.

In the method for manufacturing a heat resistant resin film with a metal thin film defined according to the fifth aspect of the invention, the heat resistant resin is removed to expose the conductive material by use of a known method when the conductive material having a function as an electrode is partially covered with the heat resistant resin so as not to function sufficiently.

According to a twenty-first aspect of the invention, there is provided an image forming apparatus comprising: an image carrier formed a latent image based on a difference in electrostatic potential on a surface thereof; a developing unit by which powdered toner including thermoplastic resin is made to adhere to the image carrier to visualize the latent image; an intermediate transferor to which a toner image formed on the image carrier is transferred temporarily; and transfer fixing unit for heating the toner image on the intermediate transferor and for bringing the melted toner image into compression bonding to a recording medium when the toner image is melted, wherein the intermediate transferor is an endless belt according to the twentieth aspect of the invention; and the transfer fixing unit includes an electromagnetic induction coil disposed in opposition to the intermediate transferor.

In such an image forming apparatus, an alternating current is applied to the electromagnetic induction coil so that magnetic flux penetrating the metal thin film of the intermediate transferor is generated, and an eddy current is generated in the metal thin film. Thus, the metal thin film generates heat so that the toner image is heated efficiently and melted. Then, the toner image is subjected to compression bonding to the recording medium so as to be transferred and fixed simultaneously to the recording medium. Thus, an excellent image can be obtained. In such a process, the intermediate transferor is heated repeatedly by the eddy current. However, since the metal thin film and the heat resistant resin film are integrated firmly, the intermediate transferor has sufficient durability against peeling or the like.

According to a twenty-second aspect of the invention, there is provided the method according to the third aspect of the invention, further comprising the steps of mixing the heat resistant resin and a plurality of kinds of materials having a difference in specific gravity from each other, wherein at least one of the plurality kinds of materials is a conductive material.

According to a twenty-third aspect of the invention, there is provided the method according to the twenty-second aspect of the invention, wherein the plurality kinds of materials are different in particle size from one another.

According to a twenty-fourth aspect of the invention, there is provided the heat resistant resin film according to the eleventh aspect of the invention, wherein the plurality kinds of materials having a difference in specific gravity from each other are dispersed in the heat resistant resin; and at least one of the plurality kinds of dispersed materials is a conductive material.

According to a twenty-fifth aspect of the invention, there is provided the heat resistant resin film according to the twenty-fourth aspect of the invention, wherein the plurality kinds of materials dispersed in the heat resistant resin are different in particle size from one another.

DETAILED DESCRIPTION OF PREFERRED EMBODIMENTS

Embodiments of the present invention will be described below with reference to the drawings.

Embodiment 1

Figure 1:
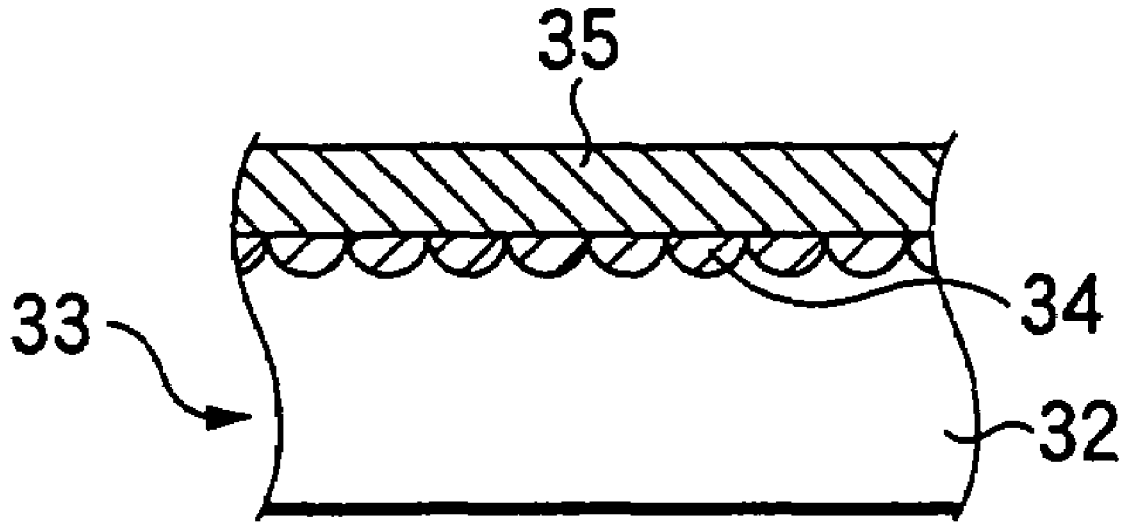
FIG. 1 is a sectional view showing a heat resistant resin film with a metal thin film according to the embodiment 1 of the present invention.
Figure 2A:
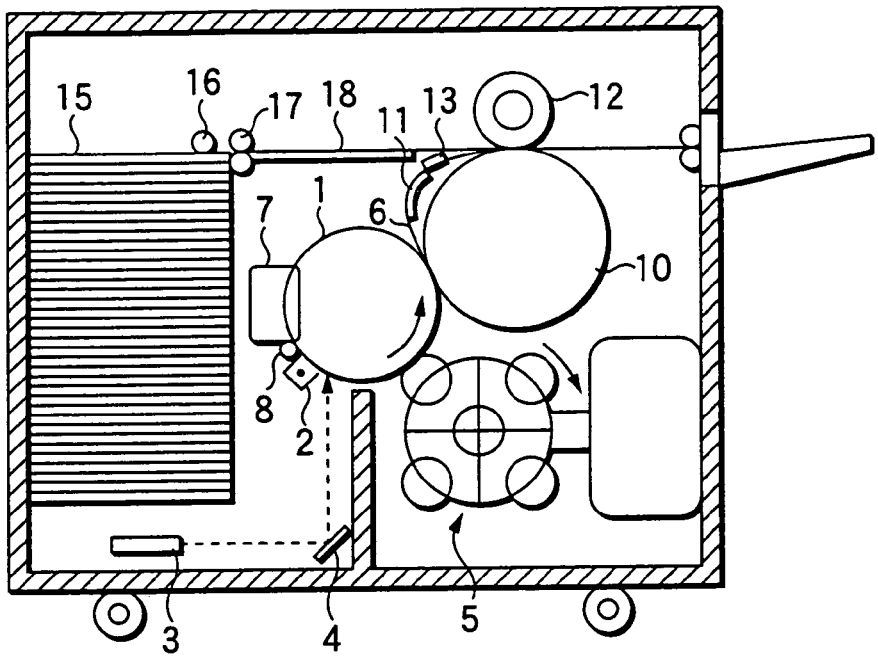
FIGS. 2A and 2B are a whole configuration view and a main portion configuration view showing an image forming apparatus to which the heat resistant resin film with a metal thin film according to the embodiment 1 is applied.
Figure 2B:
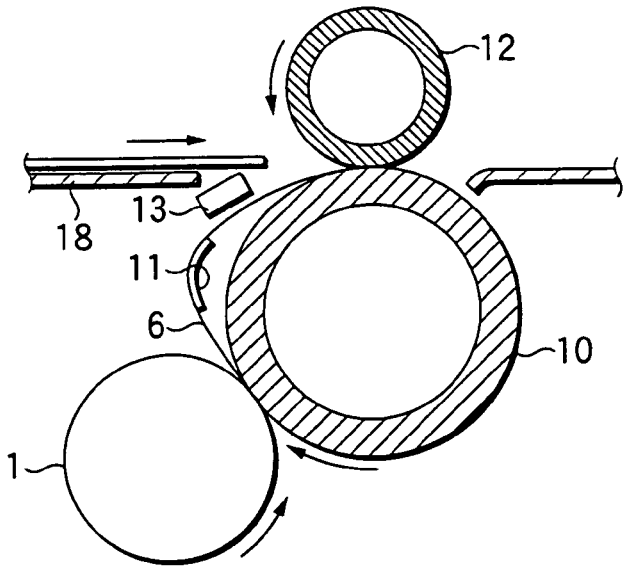

FIG. 2A shows an image forming apparatus to which a heat resistant resin film with a metal thin film and an endless belt according to this embodiment 1 of the present invention have been applied. This image forming apparatus is a full color laser printer using an electrophotographic system. FIG. 2B is an enlarged view showing a main portion of the same image forming apparatus.

This image forming apparatus has a photoconductor drum 1 as an image carrier on a surface of which a latent image is formed on a basis of a difference in electrostatic potential. Around the photoconductor drum 1, the image forming apparatus has a charging unit 2 for charging the surface of the photoconductor drum 1 substantially uniformly; an exposure section for irradiating the photoconductor drum 1 with laser light in accordance with signals of each colors of cyan, magenta, yellow, black, and so on, so as to form an electrostatic latent image on the photoconductor drum 1, the exposure section provided with a laser scanner 3 and a mirror 4 and so on; a rotary developing unit 5 for storing toners of four colors of cyan, magenta, yellow and black, respectively and visualizing the electrostatic latent image on the photoconductor drum 1 with the color toners; an intermediate transferor 6 shaped like an endless belt and supported movably and circularly in a fixed direction; a cleaning unit 7 for cleaning the surface of the photoconductor drum 1 after the transfer; and an exposure lamp 8 for removing charge from the surface of the photoconductor drum 1.

The endless intermediate transferor 6 is stretched around a driving roller 10 and a tension applying member 11. A pressure roller 12 is provided to press the driving roller 10 through the intermediate transferor 6. An electromagnetic induction heating unit 13 for heating the intermediate transferor 6 is provided on an upstream side of a position where the driving roller 10 and the pressure roller 12 are opposed to each other, in a moving direction of the intermediate transferor 6.

Further, a paper feed roller 16 and a registration roller 17 both for carrying, one by one, a recording material which is stored in a paper feed unit 15, and a recording material guide 18 for feeding the recording material between the intermediate transferor 6 and the pressure roller 12 are provided in the image forming apparatus.

Figure 3:
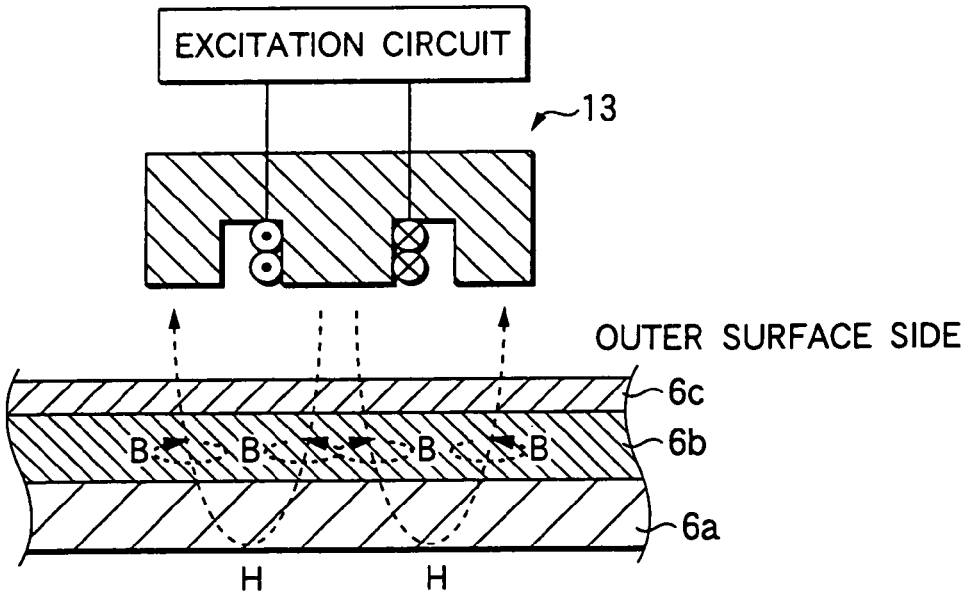
FIG. 3 is an explanatory view showing the heating principle of an intermediate transferor shaped like an endless belt.

The electromagnetic induction heating unit 13 has an exciting coil 13*a* to generate an alternating magnetic field passing through the intermediate transferor 6, as shown in FIG. 3. On the other hand, the intermediate transferor 6 has a base layer 6*a*, a conductive layer 6*b* (electromagnetic induction heating layer) laminated on the base layer 6*a*, and a releasable layer 6*c* superior in releasability. An eddy current B is generated in the conductive layer 6*b* by the alternating magnetic field. The conductive layer 6*b* generates heat due to the eddy current B so as to heat and melt the toner image carried on the surface of the intermediate transferor 6.

In such an image forming apparatus, the color toner images formed on the photoconductor drum 1 are transferred sequentially onto the intermediate transferor 6 by a bias voltage applied between the photoconductor drum 1 and the driving roller 10 so as to be superimposed sequentially. Thus, a full-color toner image is formed. The conductive layer 6*b* of the intermediate transferor 6 is heated by electromagnetic induction so that the toner image is melted. The melted toner image is superimposed on the recording material, and subjected to compression bonding to the recording material at a position between the pressure roller 12 and the driving roller 10. Thus, the toner image is transferred to the recording material and fixed thereon simultaneously.

For example, as the intermediate transferor 6, a endless belt laminated a film-like member which has a thickness of 50 to 200 μm and which is made of heat resistant resin such as thermosetting polyimide, aromatic polyamide (aramid), liquid crystal polymer, or the like and a copper thin film which has a thickness of about 1 to 50 μm on each other.

Incidentally, in this embodiment of the present invention, a method for manufacturing a heat resistant resin film with a metal thin film is designed to comprise a step of biasing a conductive material to one surface of the heat resistant resin film, and a step of forming a metal thin film on the heat resistant resin film by applying electrolytic plating to the heat resistant resin film by use of the conductive material, which is biased to the one surface of the heat resistant resin film, as an electrode.

That is, in this embodiment of the present invention, the intermediate transferor shaped like an endless belt is manufactured in the following manner.

First, description will be given on a method for manufacturing an endless belt in which a copper thin film formed by electrolytic plating and a film-like member of thermosetting polyimide have been laminated on each other.

Figure 4:
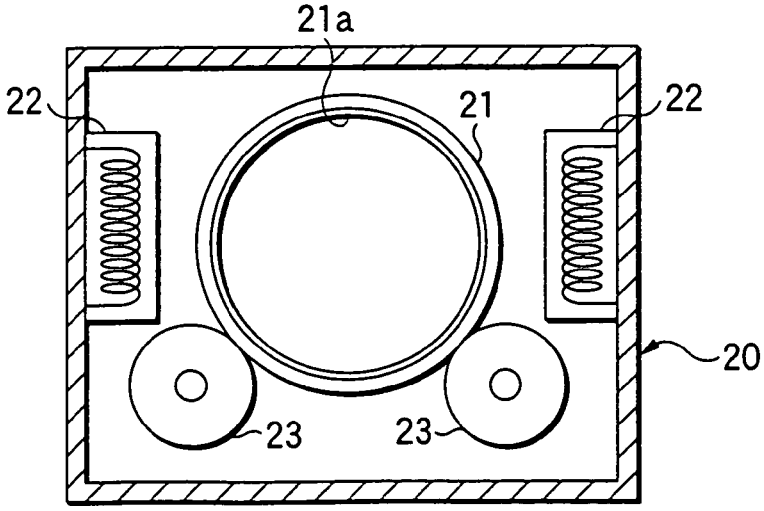
FIG. 4 is a configuration view showing an apparatus for manufacturing a heat resistant resin film with a metal thin film according to the embodiment 1 of the present invention.

This method uses a centrifugal molding machine. As shown in FIG. 4, this centrifugal molding machine 20 has a rotary drum 21 having a desired width and a desired inner diameter, heaters 22 for heating the rotary drum 21, and rollers 23 for driving and rotating the rotary drum 21 in the circumferential direction.

The inner surface of the rotary drum 21 is subjected to sufficient mirror finish. Both end portions of the rotary drum 21 in the axial direction are left opened. Ring frames 21*a* having a predetermined height for preventing materials from flowing out are provided in the end portions of the inner circumferential surface of the rotary drum 21 so as to project toward the inside thereof in the radial direction.

The two rollers 23 are supported in parallel so as to mount the rotary drum 21 on the rollers 23 and in parallel therewith. By driving and rotating one or two of the rollers 23, the rotary drum 21 is rotated. In such an apparatus, the rotary drum 21 can be detached easily with a simple structure, and work of releasing a molded film-like member, or the like, can be carried out easily.

Figure 5A:
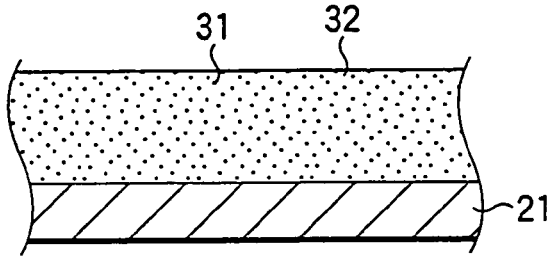
FIGS. 5A and 5B are explanatory views showing a method for manufacturing a heat resistant resin film with a metal thin film according to the embodiment 1 of the present invention, respectively.

In order to form a layer of thermosetting polyimide along the inner circumferential surface of the rotary drum 21, as shown in FIGS. 5A, the rotary drum at a room temperature is first rotated at a low velocity while a predetermined amount, which is find in advance, of a polyamide acid solution 32 mixed with electrically conductive powder (conductive material) 31 is injected into the rotary drum 21 so as to obtain a film having a desired thickness. Then, when the predetermined amount of the polyamide acid solution 32 has been injected, the rotation is accelerated gradually. After reaching a required rotation speed, the drum 21 as a whole is heated gradually. After the drum 21 has reached a predetermined temperature, the rotation speed of the drum is kept for a predetermined time. Conditions such as the predetermined time or the like vary more or less in accordance with the kind of the solvent, the concentration of the solution, the desired thickness of the film, and so on. However, from points of view of the characteristic of the film, the accuracy in biased thickness, prevention of bubble production, and so on, preferably, the optimum conditions are established in a range where the predetermined time is 10 to 60 minutes, the rotation speed at that time is 500 to 2,000 rpm, and the temperature of the drum is 80 to 200° C. The viscosity of the polyamide acid solution to which the electrically conductive powder has been added is in a range of from 10 cps to 1,000 cps, preferably in a range of from 20 cps to 200 cps. If the viscosity is lower than 10 cps, dispersion of fluororesin particulates (as well as the electrically conductive powder) in the solution deteriorates so as to cause aggregation or precipitation easily. If the viscosity exceeds 1,000 cps, the accuracy in film thickness of the obtained seamless tubular film of polyamide acid deteriorates. In order to disperse the particulates gradiently, particularly preferably, the viscosity is in a range of from 50 cps to 170 cps. In this embodiment, 10 μm copper particles are used as the conductive material.

Figure 6A:
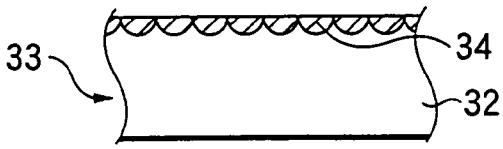
FIGS. 6A and 6B are explanatory views showing the method for manufacturing a heat resistant resin film with a metal thin film according to the embodiment 1 of the present invention, respectively.

When the predetermined time has passed in the heating state under a nitrogen atmosphere, heating is stopped. Then, the rotation is stopped when the drum as a whole has been cooled to the room temperature. Next, a molded body is taken out from the drum inner surface. The obtained molded body 33 is a polyamide acid endless film with an electrode 34 including a small amount of residual solvent as shown in FIG. 6A.

Next, the polyamide acid endless film 33 is put into a hot air dryer so that the temperature of the endless film 33 is increased up to a predetermined temperature. Heating is continued at that temperature for a predetermined time. It is preferable that the temperature under the nitrogen gas atmosphere is in a range of from 350° C. to 500° C., and the time is in a range of from 3 minutes to 30 minutes. When heating performed for the predetermined time is finished, the heating is stopped. The endless film 33 is taken out when it has been cooled to the room temperature. Thus, the residual solvent is removed perfectly so that a thermosetting polyimide endless film with a copper electrode is obtained.

Figure 6B:
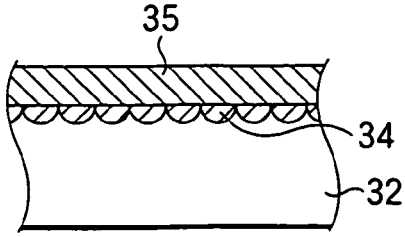
Figure 7:
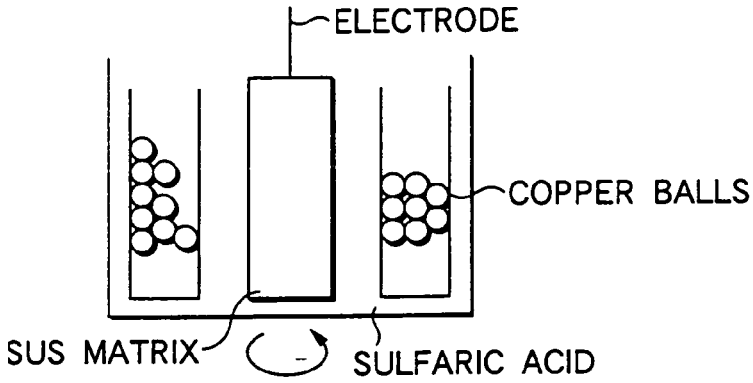
FIG. 7 is a configuration view showing an apparatus for manufacturing a heat resistant resin film with a metal thin film according to the embodiment 1 of the present invention.

Next, plating with copper is applied to a surface of the formed electrode 34. First, by use of a plating bath of copper pyrophosphate of pH 8.5 including 17 g/L of copper and 500 g/L of potassium pyrophosphate, as shown in FIG. 7, cathode electrolysis is carried out at a bath temperature of 50° C. and at a current density of 3 A/dm$^2$, so as to deposit a copper layer of 1 μm thick. Further, a surface of the ultra-thin sheet of copper foil formed is rinsed, and by use of a plating bath of copper sulfate including 80 g/L of copper and 150 g/L of sulfuric acid, cathode electrolysis is carried out at a bath temperature of 50° C. and at a current density of 60 A/dm$^2$, so as to deposit a copper layer of 4 μm thick. Thus, a copper foil layer 35 having 5 μm thick as a whole is formed as shown in FIG. 6B.

Before copper plating is carried out, electrolytic plating may be carried out after the electrode is surely exposed by sandblasting, chemical etching, or the like, so as to ensure electric bonding.

Thermosetting polyimide for use as heat resistant resin is polymerized with a repeat unit in which an imide group is directly bonded with an organic group in a molecular main chain. The organic group means an aliphatic group or an aromatic group. It is preferable that the organic group is an aromatic group such as a phenyl group, a naphthyl group, a diphenyl group (including a group in which two phenyl groups are bonded to each other through a methylene group or a carbonyl group) because its mechanical characteristic does not deteriorate at a higher working temperature. Generally, a method for manufacturing the thermosetting polyimide comprises a step of bringing organic dianhydride such as tetracarboxylic dianhydride, for example, pyromelletic dianhydride, 2,2,3,3-biphenyltetracarboxylic dianhydride, 3,3,4,4-benzophenonetetracarboxylic dianhydride-bis (2,3-dicarboxylic phenyl) methanoic dianhydride, or the like and an equivalent of organic diamine such as p-phenylenediamine, 4,4'-diaminodiphenylmethane, 4,4'-diaminodiphenyl ether, or the like, into polycondensation reaction at a temperature lower than the room temperature in an organic polar solvent such as dimethylacetamide, N-methylpyrrolidone, or the like, so as to obtain a polyamide acid solution and a step of drying, molding, and baking this solution to obtain thermosetting polyimide.

Figure 11A:
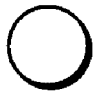
FIGS. 11A and 11B are explanatory views showing conductive materials, respectively.
Figure 11B:
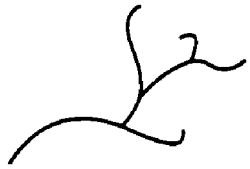
Figure 12A:
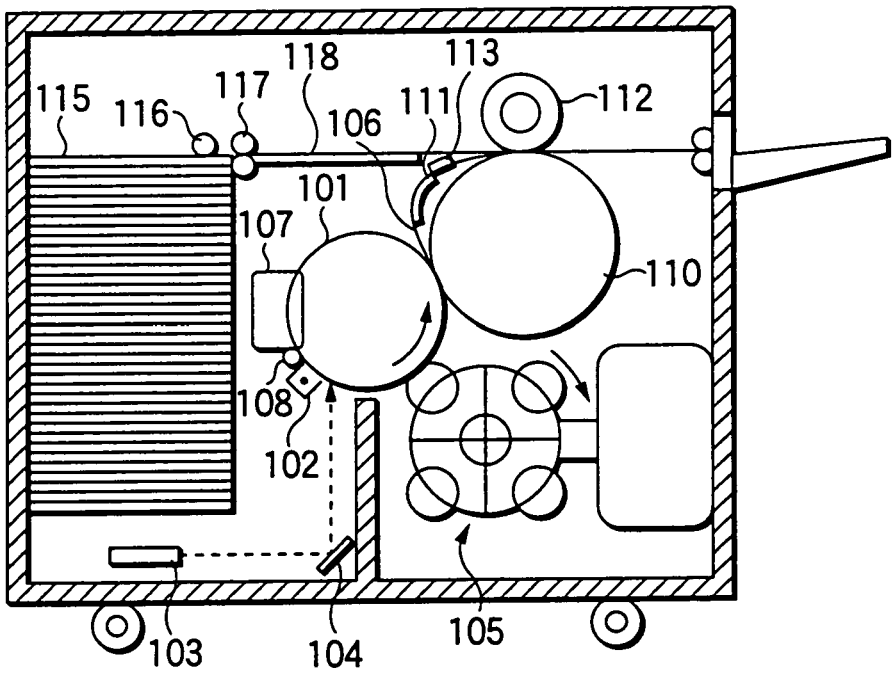
FIGS. 12A and 12B are a whole configuration view and a main portion configuration view showing an image forming apparatus to which a heat resistant resin film with a metal thin film according to a related art is applied.
Figure 12B:
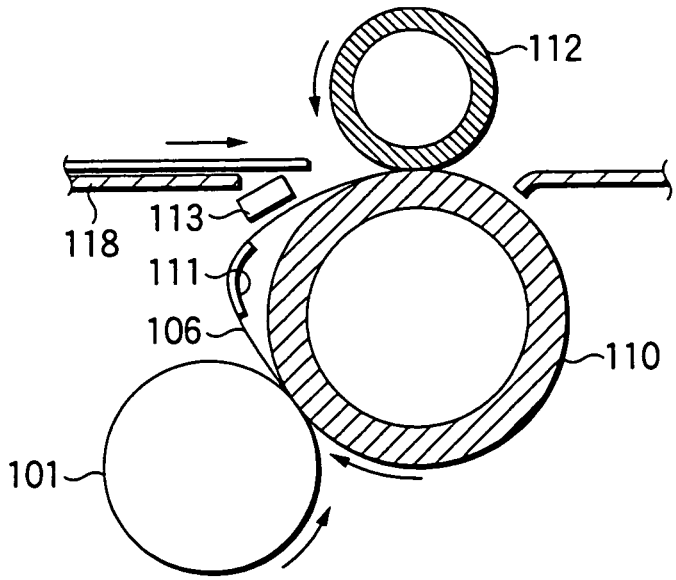
Figure 13:
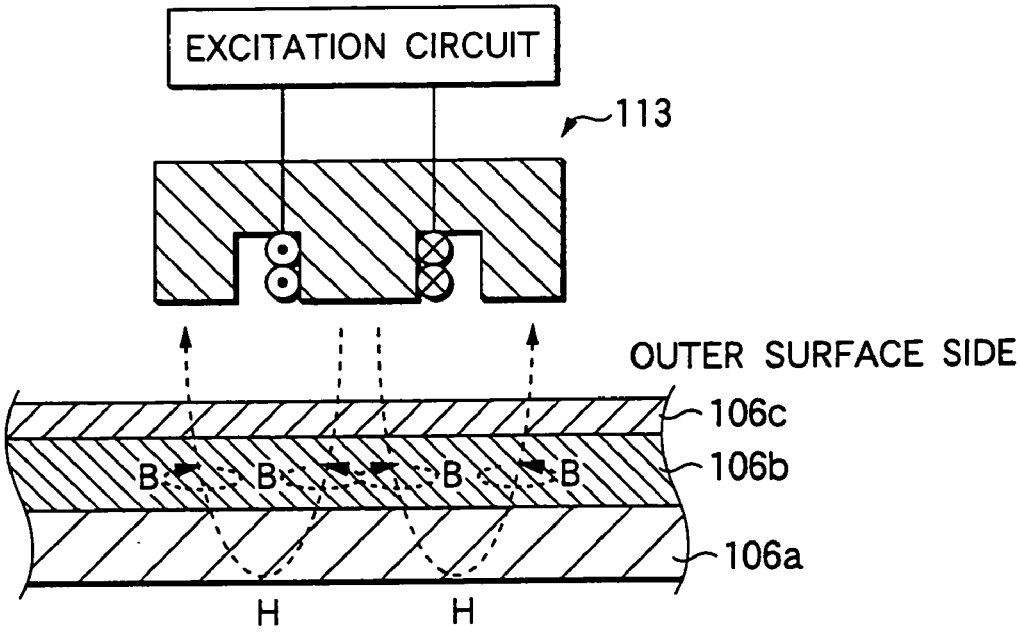
FIG. 13 is an explanatory view showing the heating principle of an intermediate transferor shaped like an endless belt.

In this embodiment, metal particles are used as the conductive material. Any material may be used as the conductive material so long as it functions as an electrode. For example, 20 μm copper particles made by FUKUDA METAL FOIL POWDER Co., Ltd., or the like, is preferable. The copper particles may be spherical copper particles produced in an atomizing method, or dendritic copper particles produced in an electrolytic method as shown in FIGS. 11A and 11B. Although either spherical particles or dendritic particles may be used, the dendritic ones are suitable in consideration of firm adhesion to the heat resistant resin. Any metal is heavier in specific gravity than the heat resistant resin. Thus, the metal is collected on the side where centrifugal force is applied by centrifugal molding or the like. Of sulfides, copper sulfide also has electrical conductivity. Therefore, copper sulfide may be used as an electrode. Any compound may be used so long as it is conductive.

An organic polymer may be used in place of the metal particles. As the organic polymer, polymer obtained by polymerizing monomer of pyrrole and derivatives thereof, polymer obtained by polymerizing monomer of thiophene and derivatives thereof, and so on, may be used.

Inorganic or organic conductive materials may be used in mixture.

As another embodiment, since heat resistant resin including a conductive material which has been cast to be planar by a blade or the like is left so that the conductive material is collected (dipped) in a lower layer by its own weight, a flat film can be manufactured likewise with the layer of the conductive material as an electrode.

Embodiment 2

In this embodiment 2, an endless belt made of the heat resistant resin film according to the embodiment 1 is designed for use not as an intermediate transferor but as an endless heating belt in a fixing unit.

That is, an object of a fixing unit according to this embodiment is to shorten warm-up time and to ensure release performance of a recording medium. A belt-like flexible member having a small heat capacity is used as a fixing member. The fixing unit is designed so that members absorbing heat are reduced to the utmost (members are disposed as few as possible) in the inside of the belt-like member. That is, there is adopted a configuration in which only a pad member (press member) having an elastic layer for forming a fixing nip portion is basically provided inside the belt-like member (heating belt) so as to be opposite to a pressure member. There is used a system in which the belt-like member to be heated is provided with a conductive layer so that the belt-like member can be heated directly. Thus, induction heating is carried out by a magnetic field generated by magnetic field generating means.

Figure 8:
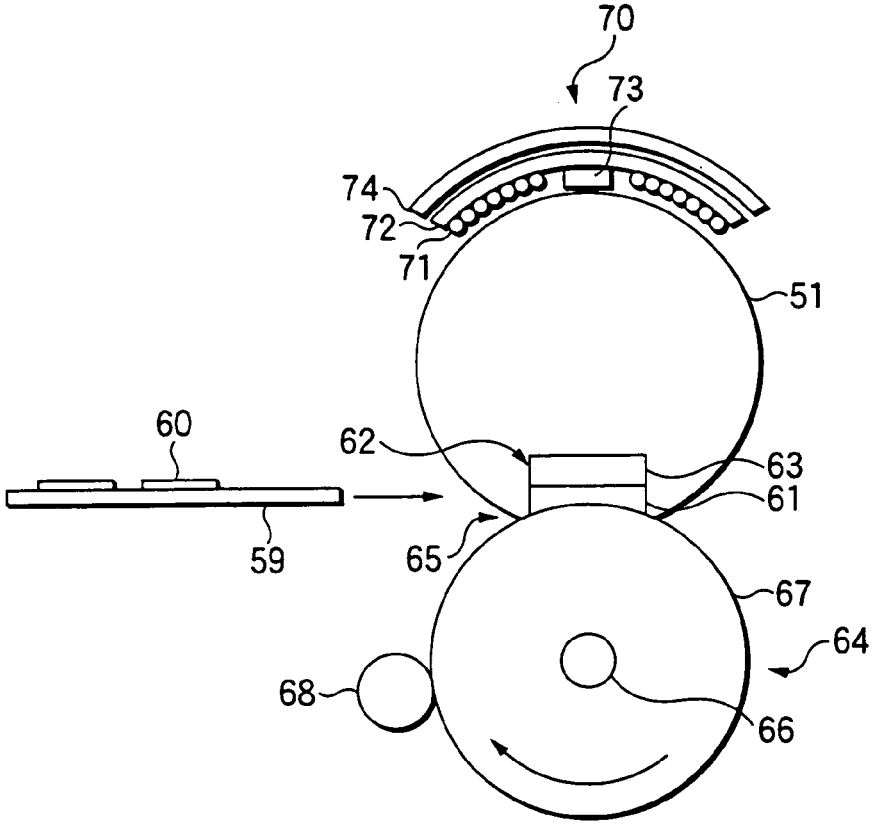
FIG. 8 is a configuration view showing a fixing unit to which a heat resistant resin film with a metal thin film according to an embodiment 2 of the present invention is applied.

FIG. 8 is a schematic configuration view showing a fixing unit using an endless belt made of a heat resistant resin film according to embodiment 2 of the present invention.

Figure 9:
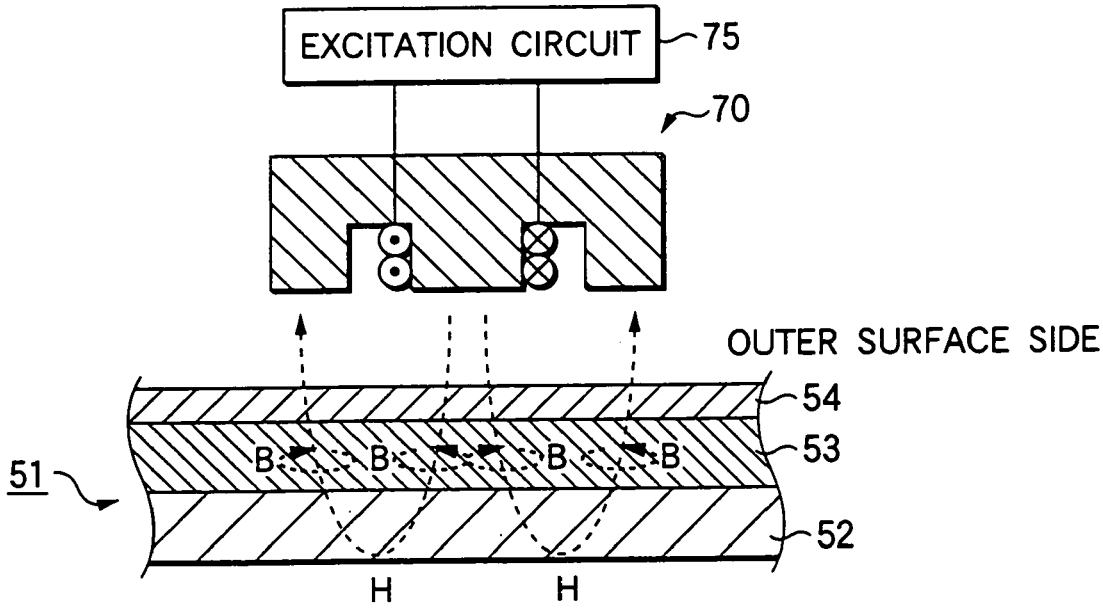
FIG. 9 is an explanatory view showing the heating principle of a heating belt.

In FIG. 8, the reference numeral 51 represents a heating belt as a heating/fixing member. This heating belt 51 is constituted by an endless belt having a conductive layer. The heating belt 51 basically has at least three layers, that is, a substrate layer 52 made of heat resistant resin, a conductive layer 53 laminated on the substrate layer 52, and a surface releasable layer 54 disposed as the uppermost layer, in this order from the inside of the heating belt 51, as shown in FIG. 9. In this embodiment, an endless belt having a diameter of ϕ30 mm and formed of the three layers of the sheet-like substrate layer 52, the conductive layer 53 and the surface releasable layer 54 is used as the heating belt 51.

For example, the substrate layer 52 of the heating belt 51 is preferably a high heat-resistant sheet having 10 to 100 μm thick, more preferably 50 to 100 μm thick (e.g., 75 μm) such polyester, polyethylene terephthalate, polyethersulfone, polyetherketone, polysulfone, polyimide, polyimide amide, polyamide, or the like.

Figure 10:
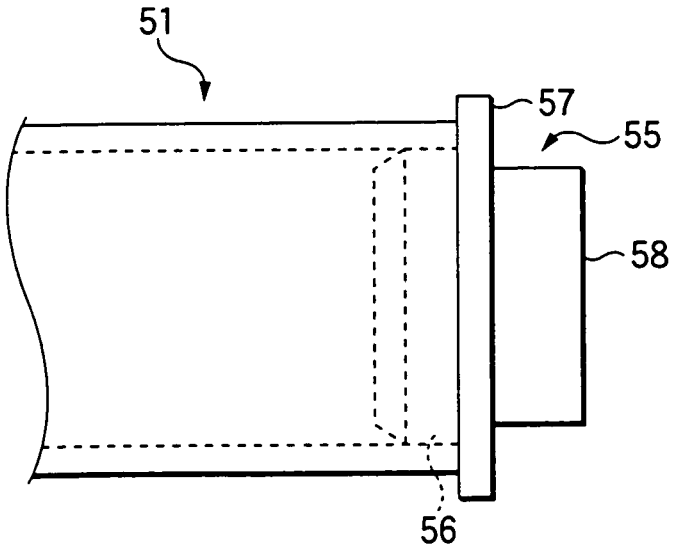
FIG. 10 is a configuration view showing a support structure of the heating belt.

In this embodiment, as shown in FIG. 10, both end portions of the heating belt 51 formed of an endless belt are made to abut against edge guides 55, respectively, so that the heating belt 51 is restricted not to meander in use. Each of the edge guides 55 comprises a cylindrical portion 56 having an outer diameter a little smaller than the inner diameter of the heat belt 51, a flange portion 57 provided in an end portion of the cylindrical portion 56 and a cylindrical or columnar retention portion 58 provided to project from the flange portion 57. The edge guides 55 are disposed to be fixed to the both end portions of the heating belt 51 so that the distance between the inner wall surfaces of the flange portions 57 becomes a little larger than the length of the heating belt 51 in an axial direction. Therefore, the substrate layer 52 needs to have rigidity which is large enough to retain the circular shape of a diameter of ϕ30 mm in any portion other than the nip portion during the rotation of the heating belt 51, and which is large enough not to produce buckling or the like in the heating belt 51 even if an end portion of the heating belt 51 abuts against either of the edge guides 55. For example, a polyimide sheet having 50 μm thick is used.

The conductive layer 53 is a layer for induction heating based on the electromagnetic induction effect of a magnetic field generated by magnetic field generating means which will be described later. A metal layer of iron, cobalt, nickel, copper, chromium, or the like, formed to be about 1 to 50 μm thick is used as the conductive layer 53. Incidentally, in this embodiment, inside the nip portion formed by a pad and a pressure roll which will be described later, the heating belt 51 is required to follow the shape of the nip portion. Therefore, the heating belt 51 has to be a flexible belt, and the metal layer 53 is preferably formed into a layer as thin as possible.

In embodiment 2 of the present invention, copper having a high conductivity formed on the substrate layer 52 in a similar manner to the embodiment 1 so as to have an extremely small thickness of about 5 μm to increase the heat generation efficiency is used as the conductive layer 53.

Further, since the surface releasable layer 54 is a layer directly contacting an unfixed toner image 60 transferred onto a recording medium 59, it is necessary to use a material superior in releasability as the surface releasable layer 54. Examples of the material forming the surface releasable layer 54 include tetrafluoroethylene perfluoro alkyl vinyl ether polymer (PFA), polytetrafluoroethylene (PTFE), silicon copolymer, a composite layer of these above materials, and so on. As the surface releasable layer 54, one material suitably selected from these materials is provided in the uppermost layer of the belt so as to be 1 to 50 μm thick. If the surface releasable layer 54 is too thin, the durability deteriorates in terms of abrasion resistance, so that the life of the heating belt 51 is shortened. On the contrary, if the surface releasable layer 54 is too thick, the heat capacity of the belt becomes large, that is, the warm-up time is prolonged undesirably.

In this embodiment, tetrafluoroethylene perfluoro alkyl vinyl ether polymer (PFA) 10 μm thick is used as the surface releasable layer 54 of the heating belt 51 in consideration of a balance between abrasion resistance and heat capacity of the belt.

Inside the heating belt 51 configured thus, for example, a pad member 62 having an elastic layer 61 of silicon rubber or the like is provided as a press member. In this embodiment, a member is which silicon rubber 61 having a rubber hardness of 35° in JIS-A has been laminated on a support member 63 is used as the pad member 62, while the support member 63 has rigidity and is made of metal such as SUS iron, high heat-resistant synthetic resin, or the like. As the elastic layer 61 made of silicon rubber, for example, an elastic layer having a uniform thickness is used. The support member 63 of the pad member 62 is disposed to be fixed to a not-shown frame of the fixing unit. However, the support member 63 may be pressed toward the surface of a pressure roll, which will be described later, by not-shown urging means such as a spring or the like, so that the elastic layer 61 is subjected to compression bonding to the surface of the pressure roll by a predetermined pressing force.

Then, in the fixing unit, a pressure roll 64 is provided in a portion opposite to the pad member 62 through the heating belt 51. This pressure roll 64 retains the heating belt 51 in a state where the heating belt 51 is held between the pressure roll 64 and the pad member 62, so as to form a nip portion 65. A recording medium 59 to which the unfixed toner image 60 is fixed onto the recording medium 59 by heat and pressure. Thus, a fixed image is formed.

In this embodiment, a pressure roll having a solid iron roll 66 and a releasable layer 67 is used as the pressure roll 64, while the surface of the solid iron roll 66 having a diameter of ϕ26 mm is coated with tetrafluoroethylene perfluoro alkyl vinyl ether polymer (PFA) 30 μm thick as the releasable layer 67.

A metal roll 68 made of metal superior in thermal conductivity, such as aluminum, stainless steel, or the like, is detachably provided on the pressure roll 64 as shown in FIG. 8. This metal roll 68 stops in a position detached from the pressure roll 64 when the heating belt 51 or the pressure roll 64 is cool, for example, when electric conduction to the fixing unit is started early in the morning, and so on. Then, for example, in such a case that small-size paper is fixed continuously in the fixing unit, there may occur a difference in temperature in the axial direction in the heating belt 51 or the pressure roll 64 as the fixing unit is used. In such a case, the metal roll 68 is brought into contact with pressure roll 64. Incidentally, the metal roll 68 is driven to follow the pressure roll 64 when the metal roll 68 abuts against the pressure roll 64. In this embodiment, a solid roll made of aluminum and having a diameter of ϕ10 mm is used as the metal roll 68.

In this embodiment, the pressure roll 64 is driven to rotate by not-shown driving means such as motor or the like in a state where the pressure roll 64 is pressed against the pad member 62 through the heating belt 51 by not-shown pressing means.

The heating belt 51 which is a heating member moves circularly following the rotation of the pressure roll 64. Therefore, in this embodiment, in order to improve the sliding property, a sheet material which is high in abrasion resistance and excellent in sliding property, such as a glass fiber sheet (CHUKOH CHEMICAL INDUSTRIES, LTD.: FGF400-4 or the like) impregnated with Teflon resin, is interposed between the heating belt 51 and the pad member 62. Further, a release agent such as silicon oil is applied, as lubricant, to the inner surface of the heating belt 51, so as to improve the sliding property. Thus, during real heating, the driving torque of the pressure roll 64 at a time of idle rotation can be reduced from about 6 kg·cm to about 3 kg·cm. Accordingly, the heating belt 51 follows the pressure roll 64 without sliding thereon, so that the heating belt 51 can move circularly at a velocity equal to the rotation velocity of the pressure roll 64.

As described above, the axial movement of the heating belt 51 is restricted at the both end portion thereof in the axial direction by the edge guides 55 as shown in FIG. 10. Thus, the heating belt 51 is prevented from meandering or the like.

Incidentally, this embodiment is designed so that a thin heating belt having a conductive layer is subjected to induction-heating by a magnetic field generated by magnetic field generating means.

The above-mentioned magnetic field generating means 70 is a member formed to be long in a width direction when a length direction is a direction perpendicular to the rotation direction of the heating belt 51 which is a member to be heated. The magnetic field generating means 70 is disposed outside the heating belt 51 while a gap of about 0.5 mm to 2 mm is kept between the magnetic field generating means 70 and the heating belt 51. In this embodiment, the magnetic field generating means 70 comprises an exciting coil 71, a coil support member 72 for holding the exciting coil 71, a core material 73 provided in the center portion of the exciting coil 71 and made of a ferromagnetic material, and a magnetic field shielding means 74 provided for the exciting coil 71 on the opposite side to the heating belt 51.

For example, a coil is used as the exciting coil 71. In the coil, a predetermined number of Litz wires each constituted by a bundle of 16 copper wire which have a diameter of ϕ0.5 mm and are insulated from one another are arranged rectilinearly in parallel.

As shown in FIG. 9, an alternating current of a predetermined frequency is applied to the exciting coil 71 by an excitation circuit 75 so as to generate a fluctuating magnetic file H around the exciting coil 71. When the fluctuating magnetic field H comes across the conductive layer 53 of the heating belt 51, an eddy current B is generated in the conductive layer 53 of the heating belt 51 by the electromagnetic induction effect so as to generate a magnetic field preventing the fluctuation of the magnetic field H. The frequency of the alternating current applied to the exciting coil 71 is, for example, set to be in a range of from 10 kHz to 50 kHz. In this embodiment, the frequency of the alternating current is set to 30 kHz. Then, the eddy current B flows through the conductive layer 53 of the heating belt 51 so as to generate Joule heat with electric power ($W=I^2R$) proportional to the resistance of the conductive layer 53. Thus, the heating belt 51 which is a heating member is heated.

It is preferable that a non-magnetic material having heat resistance is used as the coil support member 72. For example, heat resistant glass, or heat resistance resin such as polycarbonate, or the like, is used.

A magnetic material such as iron, cobalt, nickel, ferrite, or the like, is used as the magnetic field shielding means 74. The magnetic field shielding means 74 collects magnetic flux generated in the exciting coil 71 so as to form a magnetic circuit. Thus, efficient heating is made possible, while the magnetic flux is prevented from leaking outside the fixing unit to heat peripheral members unwillingly.

The core material 73 made of ferrite or the like which is a ferromagnetic material is provided in the center portion of the exciting coil 71. With such a configuration, the magnetic flux generated in the exciting coil 71 can be collected efficiently so as to increase the heating efficiency. As a result, the frequency of a high frequency power supply for applying an alternating current to the exciting coil 71 can be reduced, or the number of windings of the exciting coil 71 can be reduced. Thus, the power supply can be reduced in size, the exciting coil 71 can be miniaturized, and the cost can be reduced.

Accordingly, the heat resistant resin film can be also used as a heating belt of a fixing unit.

Embodiment 3

Figure 14:
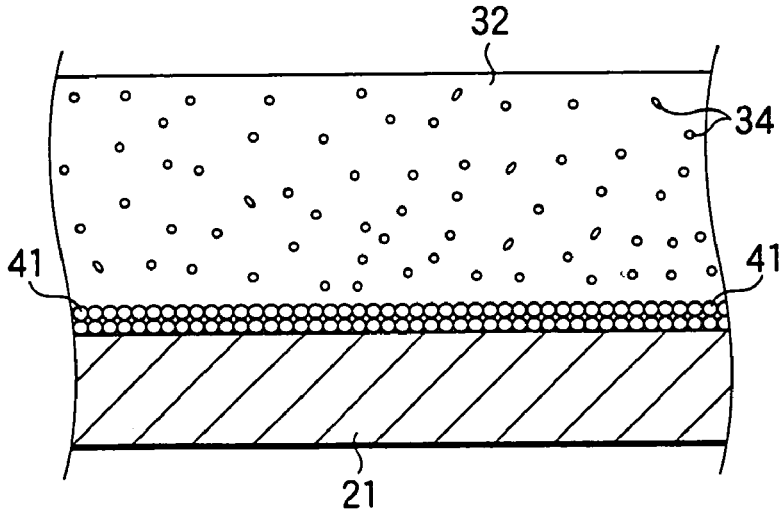
FIG. 14 is an explanatory view showing a method for manufacturing a heat resistant resin film with a metal thin film according to an embodiment 3 of the present invention.

FIG. 14 shows the embodiment 3 of the present invention. Parts the same as those in embodiment 1 are referenced correspondingly for the following description. The embodiment 3 provides a method for manufacturing a heat resistant resin film with a metal thin film in which two or more kinds of materials having a difference in specific gravity are dispersed into heat resistant resin, and at least one of the two or more kinds of dispersed materials is a conductive material; and a heat resistant resin film with a metal thin film manufactured by the manufacturing method.

In the embodiment 3, for example, the two or more kinds of materials dispersed into the heat resistant resin are different in particle size from one another.

As described above, examples of the above-mentioned heat resistant resin may include polyester, polyethylene terephthalate, polyethersulfone, polyetherketone, polysulfone, polyimide, polyimide amide, polyamide, and so on. Particularly, it is preferable to use a material classified as polyimide, aromatic polyamide, or thermotropic liquid crystal polymer. Examples of the thermotropic liquid crystal polymer may include perfect aromatic polyester, aromatic-aliphatic polyester, aromatic polyazomethine, aromatic polyester-carbonate, polybenzimidazole, and so on. Particularly, polybenzimidazole is preferred because its thermal expansion coefficient is small. These examples may be used in desired mixture.

In this embodiment, two or more kinds of materials having a difference in specific gravity are dispersed into heat resistant resin, and at least one of the two or more kinds of dispersed materials is a conductive material. Incidentally, as for the materials dispersed into the heat resistant resin, for example, not to say, all the two or more kinds of materials may be conductive materials, or a part of the two or more kinds of materials, that is, one or more kinds of materials may be conductive materials.

The two kinds of conductive materials to be dispersed into the heat resistant resin are copper and nickel by way of example. Copper and nickel have a difference in specific gravity (density), and are set to be different in particle size from each other. The copper particles are set to 2.5 μm in particle size, and the density thereof is 8,880 $Kg/m^3$. On the other hand, the nickel particles are set to 3.5 μm in particle size to be larger than that of the copper particles, and the density thereof is 8,899 $Kg/m^3$.

Figure 5B:
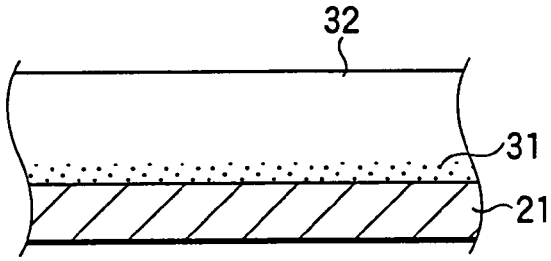

The copper particles and the nickel particles are added by 2.5 parts, respectively, by weight per 100 parts of polyamide acid solution. After the copper particles and the nickel particles are dispersed by a ball mill, centrifugal molding is carried out as shown in FIG. 4 and FIGS. 5A and 5B.

Then, the copper particles 34 are more difficult to be dispersed into a polyamide acid solution 32 than the nickel particles 41 for unknown reasons. Thus, plenty of the copper particles 34 exit inside the polyamide acid solution 32 as shown in FIG. 14. On the other hand, since the density of the nickel particles 41 is larger than that of the copper particles 34, plenty of the nickel particles 41 are unevenly distributed over the surface of the polyamide acid solution 32. Therefore, in an endless film of thermosetting polyimide finally obtained from an endless film 33 of polyamide acid, plenty of the nickel particles 41 are separated out on the surface of the endless film of thermosetting polyimide so that the surface can be made easy to be plated. The plenty of the copper particles 34 exist inside the endless film of thermosetting polyimide so that the heat conductivity of the resin film can be improved.

Accordingly, when an endless belt is manufactured by use of the above described resin film, the heat conductivity of the endless belt in the width direction is improved so that the temperature distribution of the endless belt in the width direction can be made more uniform.

Incidentally, although the above-mentioned embodiment has described the case where copper particles and nickel particles were added by the same quantity, they may be dispersed into a solid which has not been made into polyimide, in a condition that the quantity of the nickel particles is a little larger. In such a case, the nickel particles have a catalyst effect to accelerate crosslinking reaction around the nickel particles. Thus, the solid changes into spherical polymers different in molecular weight so that the spherical polymers exist in a dispersed state, or the solid becomes a mixture of polymers different in molecular weight. Thus, the mechanical strength or the like can be improved.

As the two kinds of conductive materials to be dispersed into the heat resistant resin, for example, silver and aluminum may be used. The density of silver is 10,490 $Kg/m^3$ while the density of aluminum is 2,688 $Kg/m^3$. The difference in density between silver and aluminum is so large that silver and aluminum can be mixed while the compounding ratio, the difference in particle size, and so on between the silver and the aluminum is desirably set.

Figure 15:
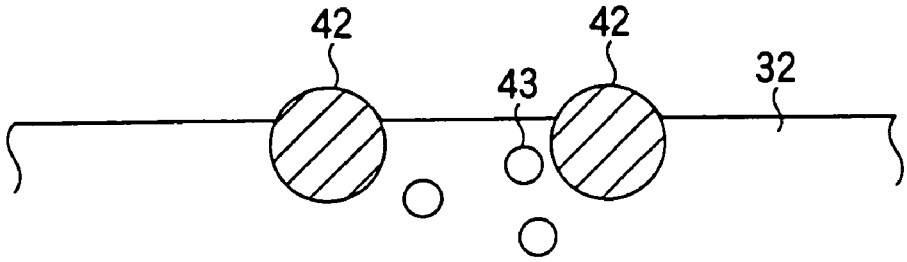
FIG. 15 is an explanatory view showing the method for manufacturing a heat resistant resin film with a metal thin film according to the embodiment 3 of the present invention.
Figure 16A:
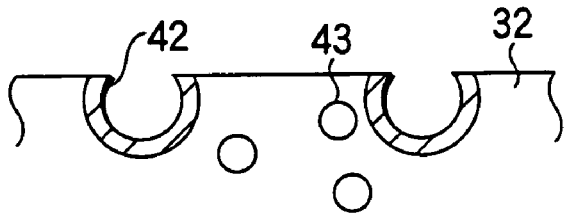
FIGS. 16A and 16B are explanatory views showing the method for manufacturing a heat resistant resin film with a metal thin film according to the embodiment 3 of the present invention.
Figure 16B:
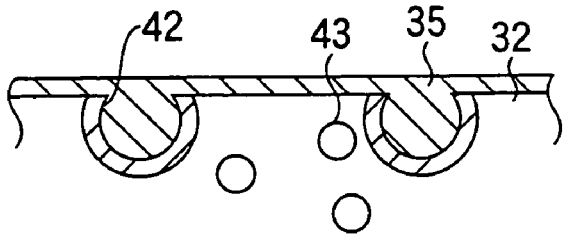

For example, the particle size of aluminum particles 42 may be set to be much larger than the particle size of silver particles 43, so that plenty of the aluminum particles 42 are unevenly distributed over the surface of the polyamide acid solution 32, as shown in FIG. 15, when centrifugal molding is carried out. In such a case, a thermosetting polyimide film manufactured is dipped into acid such as hydrochloric acid or the like so that the aluminum particles 42 are wholly or locally dissolved as shown in FIGS. 16A and 16B. Thus, plating 35 is made easy to adhere to the aluminum particles, or air gaps G are formed intentionally in the aluminum particles 42 each having a large particle size so that plating 35 may grow up to the inside of the gaps G of the aluminum particles 42 located inside the thermosetting polyimide film. Thus, the plating 35 can be physically or mechanically fixed firmly to the aluminum particles 42 which are conductive particles.

Further, of the two or more kinds of materials to be dispersed into the heat resistant resin, a material other than conductive materials may be powder of ceramics or the like, such as alumina having a particle size of about 2.5 μm and a density of 3,890 $Kg/m^3$, by way of example. Instead of alumina, beryllia having a density of 2,950 $Kg/m^3$, magnesia having a density of 3,510 $Kg/m^3$, or the like, may be used.

Since the density of the powder of alumina or the like other than metal is much smaller than that of metal, the speed of separating out the powder of alumina or the like on the surface is slower than that of metal particles when the centrifugal molding is carried out. Thus, plenty of the powder of alumina or the like is dispersed into the resin of a solution of polyamide acid or the like, so that the heat conductivity of the resin film as a whole can be improved while the mechanical strength can be improved.

Therefore, when an endless belt is manufactured by use of such a resin film, the heat conductivity of the endless belt in the width direction can be improved while the mechanical strength of the endless belt can be improved. Thus, the life of the endless belt can be prolonged.

When a plurality of kinds of powders of alumina and so on other than metal are to be dispersed, they are added by 2.5 parts, respectively, by weight per 100 parts of the polyamide acid solution, and dispersed by a ball mill. After that, centrifugal molding is carried out as shown in FIG. 4 and FIGS. 5A and 5B.

Incidentally, as the material to be dispersed into the heat resistant resin, aluminum nitride, tin oxide, or the like, superior in heat conductivity may be used.

Although materials different in particle size, as the two or more kinds of materials to be dispersed into the heat resistant resin, may be added by the same quantity, a material smaller in particle size and a material larger in particle size may be dispersed so that the former is more than the latter, for example, at the ratio of 7:3, in order to obtain a reinforcement effect.

As described above, according to the present invention, it is possible to provide a heat resistant resin film with a metal thin film in which the metal thin film has sufficient mechanical strength and which can be manufactured in a simple process and at a low cost; a method for manufacturing the heat resistant resin film; an endless belt; a method for manufacturing the endless belt; and an image forming apparatus. In addition, according to the present invention, a conductive material is biased to one surface of the heat resistant resin film, and the conductive material biased to the one surface of the heat resistant resin film is used as an electrode so as to apply electrolytic plating to the heat resistant resin film. Thus, a metal thin film is formed on the heat resistant resin film. Accordingly, it is possible to easily obtain a heat resistant resin film with a metal thin film in which the heat resistant resin firmly adheres to the metal thin film, so that the integration is excellent and sufficient durability is satisfied.

What is claimed is:

1. A method for manufacturing a heat resistant resin film, comprised of a heat resistant resin, with a metal thin film, comprising the steps of:

mixing the heat resistant resin and a plurality of materials having a difference in specific gravities from each other, wherein at least two of the plurality of materials are conductive materials in the form of solid particles, the particle size of the first of the at least two conductive materials being different from the particle size of the second of the at least two conductive materials, and one of the two conductive materials has the largest specific gravity among the plurality of materials;

biasing at least one of the conductive materials to one surface of the heat resistant resin film; and applying electrolytic plating to the heat resistant resin film by using the conductive material biased to the one surface of the heat resistant resin film as an electrode to form a metal thin film on the heat resistant resin film.

2. The method according to claim 1, wherein the step of biasing is a centrifugal molding method in which at least one of an inorganic conductive material and an organic conductive material is subjected to gradient molding.

3. The method according to claim 1, wherein the step of biasing is dipping in which at least one of an inorganic conductive material and an organic conductive material is collected near the one surface.

4. The method according to claim 1, further comprising the steps of etching the one surface of the heat resistant resin film so that the conductive material existing near the one surface acts as an electrode, wherein the etching is one of abrasion, sandblasting, and chemical etching.

5. The method according to claim 1, wherein at least one of the conductive materials is metal particles.

6. The method according to claim 1, wherein at least one of the conductive materials is organic conductive polymer.

7. The method according to claim 1, wherein the heat resistant resin film is comprised of a heat resistant resin having polyimide as a main component.

8. The method according to claim 1, further comprising the step of forming the heat resistant resin film into an endless belt shape.

9. The method according to claim 8, wherein the metal thin film generates heat due to electromagnetic induction heating.

10. The method according to claim 1, wherein the plurality of materials are different in particle size from one another.

11. A method for manufacturing a fixing belt for heating toner to fix the toner on a recording medium, comprising the steps of:

mixing a heat resistant resin and a plurality of materials having a difference in specific gravities from each other, wherein at least two of the plurality of materials are conductive materials in the form of solid particles, the particle size of the first of the at least two conductive materials being different from the particle size of the second of the at least two conductive materials, and one of the two conductive materials has the largest specific gravity among the plurality of materials;

biasing at least one of the conductive materials in a heat resistant resin layer comprised of the heat resistant resin to one surface of the heat resistant resin layer, thereby forming an electrode composed of the conductive material on the one surface of the heat resistant resin layer; and applying electrolytic plating to the heat resistant resin layer by using the electrode to form a metal thin film on the electrode.

12. The method according to claim 11, wherein the step of biasing is a centrifugal molding method in which at least one of an inorganic conductive material and an organic conductive material is subjected to gradient molding.

13. The method according to claim 11, wherein the step of biasing is dipping in which at least one of an inorganic conductive material and an organic conductive material is collected near the one surface.

14. The method according to claim 11, further comprising the steps of etching the one surface of the heat resistant resin layer so that the conductive material existing near the one surface acts as an electrode, wherein the etching is one of abrasion, sandblasting, and chemical etching.

15. The method according to claim 11, wherein at least one of the conductive materials is metal particles.

16. The method according to claim 11, wherein at least one of the conductive materials is organic conductive polymer.

17. The method according to claim 11, wherein the heat resistant resin has polyimide as a main component.

* * * * *